US011744769B2

(12) United States Patent
Wersland et al.

(10) Patent No.: US 11,744,769 B2
(45) Date of Patent: Sep. 5, 2023

(54) ASSISTED SPEED CONTROLLER FOR PERCUSSIVE MASSAGE DEVICES

(71) Applicant: Therabody, Inc., Los Angeles, CA (US)

(72) Inventors: Jason Wersland, Manhattan Beach, CA (US); Benjamin Nazarian, Beverly Hills, CA (US); Jaime Sanchez Solana, Los Angeles, CA (US); Eduardo Merino, Beverly Hills, CA (US)

(73) Assignee: Therabody, Inc., Los Angeles, CA (US)

( * ) Notice: Subject to any disclaimer, the term of this patent is extended or adjusted under 35 U.S.C. 154(b) by 0 days.

(21) Appl. No.: 17/111,876

(22) Filed: Dec. 4, 2020

(65) Prior Publication Data

US 2021/0169733 A1 Jun. 10, 2021

Related U.S. Application Data

(60) Provisional application No. 62/943,639, filed on Dec. 4, 2019.

(51) Int. Cl.
*A61H 23/00* (2006.01)
*A61H 23/02* (2006.01)

(52) U.S. Cl.
CPC ..... *A61H 23/006* (2013.01); *A61H 23/0254* (2013.01); *A61H 2201/1215* (2013.01); (Continued)

(58) Field of Classification Search
CPC ..... A61H 23/006; A61H 23/0254; A61H 2201/5064; A61H 2201/1463; A61H 2201/1215; A61H 2201/1664
See application file for complete search history.

(56) References Cited

U.S. PATENT DOCUMENTS 1,545,027 A 7/1925 Ashlock
D143,678 S 1/1946 Wiser
(Continued)

FOREIGN PATENT DOCUMENTS

CN 201239336 Y 5/2009
CN 301664182 S 9/2011
(Continued)

OTHER PUBLICATIONS

Danielle Collins, What are Hall effect sensors and what is theirs role in de motors?, Jan. 11, 2017 (Year: 2017).*
(Continued)

*Primary Examiner* — Philip R Wiest
*Assistant Examiner* — Nathan M Le
(74) *Attorney, Agent, or Firm* — Sterne, Kessler, Goldstein & Fox P.L.L.C.

(57) ABSTRACT

A percussive massage device includes a motor including a rotor, a push rod operatively connected to the motor and configured to reciprocate in response to activation of the motor, a massage attachment coupled to a distal end of the push rod, a sensor configured to detect a rotor position of the rotor, and a controller configured to receive the rotor position, determine a rotational speed of the motor therefrom, and compare the rotational speed to a predetermined speed, wherein the controller is configured to increase operating power of the motor when the rotational speed is lower than the predetermined speed.

10 Claims, 6 Drawing Sheets

(52) U.S. Cl.
CPC ..... *A61H 2201/1463* (2013.01); *A61H 2201/1664* (2013.01); *A61H 2201/501* (2013.01); *A61H 2201/5064* (2013.01)

(56) References Cited

U.S. PATENT DOCUMENTS

| | | | | |
|---|---|---|---|---|
| 2,987,334 | A | 6/1961 | Wendling | |
| 3,705,579 | A | 12/1972 | Morini et al. | |
| D230,522 | S | 2/1974 | Rothman | |
| 4,046,142 | A | 9/1977 | Whitney | |
| 5,103,809 | A | 4/1992 | DeLuca et al. | |
| 5,207,697 | A * | 5/1993 | Carusillo | A61B 17/1626 320/115 |
| D439,984 | S | 4/2001 | Thach | |
| 6,682,496 | B1 | 1/2004 | Pivaroff | |
| 6,823,762 | B2 | 11/2004 | Hu | |
| 7,431,706 | B2 | 10/2008 | Louis | |
| 7,927,259 | B1 | 4/2011 | Rix | |
| 7,927,294 | B2 | 4/2011 | Kamimura et al. | |
| D659,644 | S | 5/2012 | Gretz | |
| 8,777,881 | B2 | 7/2014 | Tsai | |
| D756,180 | S | 5/2016 | Chen | |
| 9,889,066 | B2 | 2/2018 | Danby et al. | |
| D817,732 | S | 5/2018 | Rettler | |
| D837,395 | S | 1/2019 | Gan | |
| 10,314,762 | B1 * | 6/2019 | Marton | A61H 23/004 |
| 10,857,064 | B2 | 12/2020 | Wersland | |
| 2005/0235988 | A1 * | 10/2005 | Hansen | F04B 35/06 128/200.24 |
| 2008/0097260 | A1 | 4/2008 | Tsukada | |
| 2011/0055720 | A1 * | 3/2011 | Potter | G06F 3/017 715/747 |
| 2012/0059294 | A1 * | 3/2012 | Schubert | A61P 17/14 601/46 |
| 2013/0218058 | A1 * | 8/2013 | Ceoldo | A61H 23/00 601/46 |
| 2013/0261516 | A1 * | 10/2013 | Cilea | A61H 23/006 601/108 |
| 2015/0119771 | A1 * | 4/2015 | Roberts | A61H 23/0218 601/135 |
| 2016/0367425 | A1 | 12/2016 | Wersland | |
| 2017/0027798 | A1 * | 2/2017 | Wersland | A61H 1/008 |
| 2017/0042754 | A1 | 2/2017 | Fowers et al. | |
| 2017/0156975 | A1 * | 6/2017 | Mills | A61H 23/0254 |
| 2017/0304145 | A1 * | 10/2017 | Pepe | A61H 23/006 |
| 2018/0141188 | A1 | 5/2018 | Lai | |
| 2018/0200141 | A1 * | 7/2018 | Wersland | A61H 23/006 |
| 2019/0110945 | A1 | 4/2019 | Kawagoe | |
| 2019/0209424 | A1 | 7/2019 | Wersland | |
| 2019/0232478 | A1 * | 8/2019 | Zawisza | H02P 29/00 |
| 2021/0330539 | A1 | 10/2021 | Faussett | |

FOREIGN PATENT DOCUMENTS

| | | | |
|---|---|---|---|
| CN | 202637439 | U | 1/2013 |
| CN | 303250924 | S | 6/2015 |
| CN | 303250929 | S | 6/2015 |
| CN | 106859949 | A | 6/2017 |
| CN | 304561844 | S | 3/2018 |
| CN | 207855923 | U | 9/2018 |
| CN | 109528473 | A | 3/2019 |
| JP | S5428491 | A | 3/1979 |
| JP | H0447440 | U | 4/1992 |
| JP | 5129032 | B2 | 1/2013 |
| KR | 101162978 | B1 | 7/2012 |
| KR | 20170108550 | A | 9/2017 |
| TW | I359657 | B | 3/2012 |

OTHER PUBLICATIONS

Danielle Collins, External rotor motor basis: design and applications. Jun. 6, 2018 (Year: 2018).*

Digi-Key's North American Editors, How to Power and Control Brushless DC Motors, Dec. 7, 2016 (Year: 2016).*

Int'l Search Report and Written Opinion issued in PCT/US63426.

Defendant's Initial Invalidity Contentions, *Therabody, Inc.* v. *Tzumi Electronics LLC et al.*, Case No. SDNY-1-21-cv-07803 (PGG)(RWL), dated Aug. 17, 2022; 16 pages.

Description of Therabody GI Device, available at: https://www.therabody.com/us/en-us/faq/theragun-devices/faq-devices-1.html?fdid=faq&csortb1=sortOrder&csortd1=1 (last visited Feb. 15, 2023).

Visual Description of Hyper Ice, Inc. Raptor Device, "Raptor Solutions 1.3 Prone," available at: https://www.youtube.com/watch?v=6i1tRqdwPU8&t=156s (last visited Feb. 15, 2023); 1 page.

Holly Riddle, "Theragun vs. Hyperice vs, Hydragun: Massage Gun Showdown [Buyer's Guide]," ChatterSource: Health & Wellness, Mar. 9, 2021, available at: https://www.chattersource.com/article/massage-gun/ (ast visited Feb. 17, 2023); 14 pages.

Anthony Katz, "The Raptor: Helps Patients and Saves Your Most Valuable Tool . . . Your Hands," DC Aligned: MeyerDC, Dec. 9, 2015, available at: http://news.meyerdc.com/community/vendor-spotlight/the-raptor-helps-patients-saves-your-most-valuable-tool-your-hands/ (last visited Feb. 15, 2023); 5 pages.

Visual Description of Hyper Ice, Inc. Raptor Device, "Osteopatia Haidy Ortale—Raptor Massage," available at: https://www.youtube.com/watch?v=plyW8FBowVs (last visited Feb. 15, 2023); 1 page.

* cited by examiner

ASSISTED SPEED CONTROLLER FOR PERCUSSIVE MASSAGE DEVICES

CROSS-REFERENCE TO RELATED APPLICATIONS

This application claims the benefit of U.S. Provisional Patent Application No. 62/943,639, filed on Dec. 4, 2019, the entirety of which is incorporated by reference herein.

FIELD OF THE INVENTION

The present invention relates generally to massage devices and more particularly to an assisted speed controller for percussive massage devices.

BACKGROUND OF THE INVENTION

Percussive massage devices generally utilize motors to provide percussive effect on a user's body part. For example, see the percussive massage device taught in U.S. Pat. No. 10,857,064, the entirety of which is incorporated by reference herein. As the force a user exerts on a body part increases, however, the speed at which the percussive massage device operates may tend to decrease, thereby decreasing the percussive effect of the percussive massage device. Thus, there is a need to provide consistent speed—i.e., percussive effect—to a user's body part at varying forces.

The background description disclosed anywhere in this patent application includes information that may be useful in understanding the present invention. It is not an admission that any of the information provided herein is prior art or relevant to the presently claimed invention, or that any publication specifically or implicitly referenced is prior art.

SUMMARY OF THE PREFERRED EMBODIMENTS

In accordance with a first aspect of the present invention there is provided a percussive massage device that includes a motor including a rotor, a push rod operatively connected to the motor and configured to reciprocate in response to activation of the motor, a massage attachment coupled to a distal end of the push rod, a sensor configured to detect a rotor position of the rotor, and a controller configured to receive the rotor position, determine a rotational speed of the motor therefrom, and compare the rotational speed to a predetermined speed. The controller is configured to increase operating power of the motor when the rotational speed is lower than the predetermined speed. The controller is configured to decrease the operating power of the motor when the rotational speed is higher than the predetermined speed. In an embodiment, the motor is a brushless DC motor. The sensor may be a Hall effect sensor. The controller may be configured to limit the operating power to a predetermined maximum safe operating power.

In accordance with another aspect of the present invention, there is provided method of providing consistent percussive effect in a percussive massage device that includes a motor with a rotor. A rotor position of the rotor is determined. A rotational speed of the motor is determined from the rotor position. The rotational speed of the motor is then compared to a predetermined speed. The operating power of the motor is increased when the rotational speed is lower than the predetermined speed. The operating power of the motor is decreased when the rotational speed is higher than the predetermined speed.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
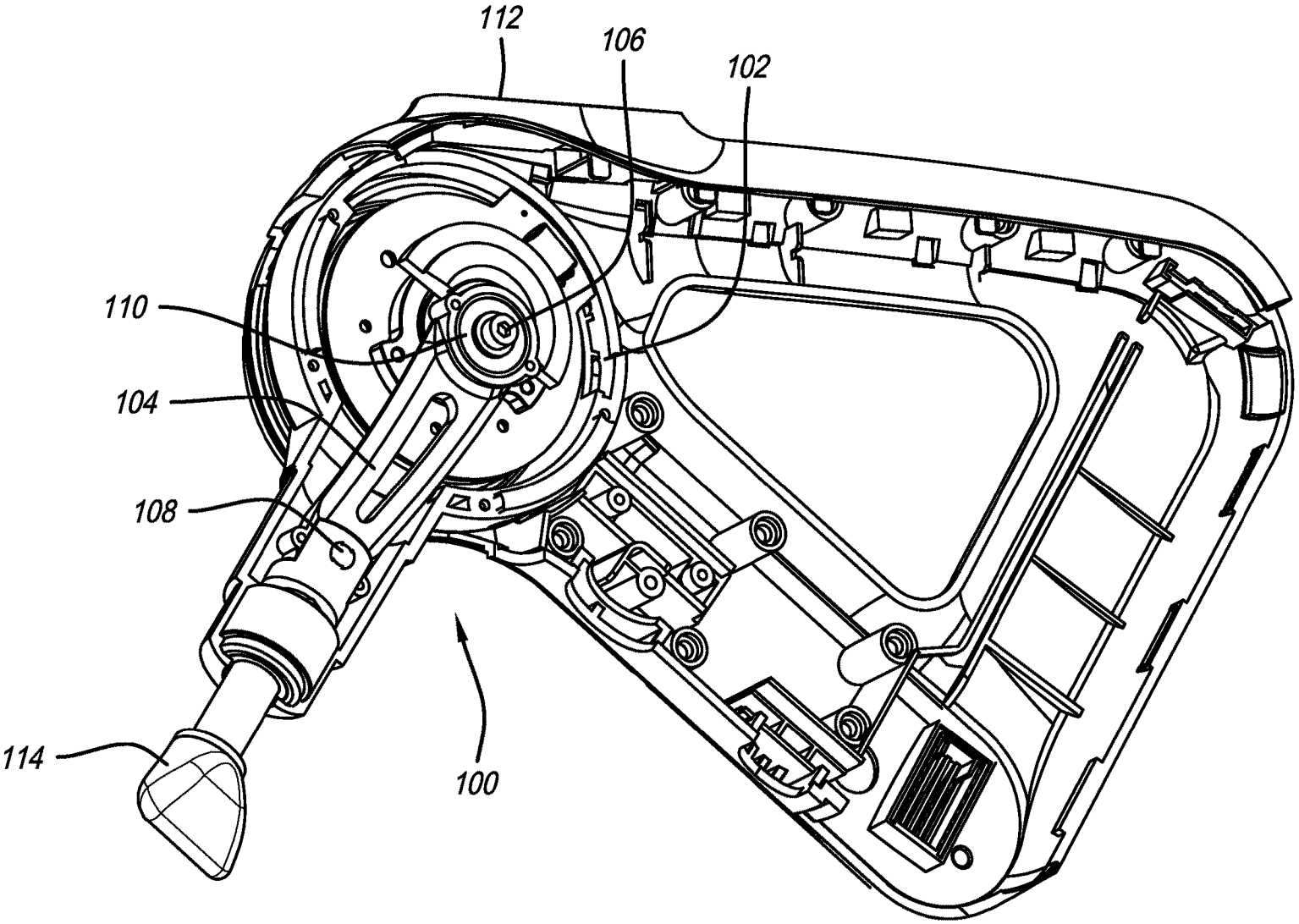
FIG. 1 is a perspective view of a percussive massage device with one side of the housing and a number of the interior components removed in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments. If a component is not shown in a drawing then this provides support for a negative limitation in the claims stating that that component is "not" present. However, the above statement is not limiting and in another embodiment, the missing component can be included in a claimed embodiment.

Reference in this specification to "one embodiment," "an embodiment," "a preferred embodiment" or any other phrase mentioning the word "embodiment" means that a particular feature, structure, or characteristic described in connection with the embodiment is included in at least one embodiment of the-disclosure and also means that any particular feature, structure, or characteristic described in connection with one embodiment can be included in any embodiment or can be omitted or excluded from any embodiment. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others and may be omitted from any embodiment. Furthermore, any particular feature, structure, or characteristic described herein may be optional. Similarly, various requirements are described which may be requirements for some embodiments but not other embodiments. Where appropriate any of the features discussed herein in relation to one aspect or embodiment of the invention may be applied to another aspect or embodiment of the invention. Similarly, where appropriate any of the features discussed herein in relation to one aspect or embodiment of the invention may be optional with respect to and/or omitted from that aspect or embodiment of the invention or any other aspect or embodiment of the invention discussed or disclosed herein.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It will be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Referring now to the drawings, which are for purposes of illustrating the present invention and not for purposes of limiting the same, the drawings show devices and components therein in accordance with preferred embodiments of a percussive massage device and a method of providing consistent percussive effect utilizing a percussive massage device. As shown in FIGS. 1-5, the percussive massage device generally includes components configured to translate rotary or rotational motion generated by a motor to reciprocal motion to provide percussive effect on a user's body part. As shown in FIG. 6, the speed of the motor is sensed and the power output to the motor is increased or decreased to ensure consistent or relatively consistent percussive effect on the user's body part.

FIG. 1 shows an embodiment of a percussive massage device 100. In a preferred embodiment, the percussive massage device 100 includes a brushless motor 102 (see FIGS. 2-5 for greater detail). As will be appreciated by those of ordinary skill in the art, the brushless motor does not include any gears and is quieter than geared motors.

The device 100 includes a push rod or shaft 104 that is connected directly to the motor 102 by a pin 106. In a preferred embodiment, the push rod 104 is L-shaped or includes an arc shape, as shown in FIG. 1. Preferably, the point where the push rod 104 is connected to the pin 106 is offset from reciprocating path that the distal end 108 of the push rod 104 (and the massage attachment) travel. This capability is provided by the arc or L-shape. It should be appreciated that the push rod 104 is designed such that it can transmit the force diagonally instead of vertically so the motor can be located at or near the middle of the device, otherwise a protrusion would be necessary to keep the shaft in the center with the motor offset therefrom (and positioned in the protrusion). Preferably two bearings 110 are included at the proximal end of the push rod where it connects to the motor to counteract the diagonal forces and preventing the push rod for moving and touching the motor.

In a preferred embodiment, the device 100 includes a screen and associated buttons, switches or the like (referred to herein together as "the controls 112" for stopping, starting, activating, etc. The controls 112 can also include other functions. For example, the controls 112 are configured to operate the motor 102 at a predetermined speed. The device the device can also include a thumbwheel or rolling button positioned near the screen/on off button to allow the user to scroll or navigate through the different functions. The screen can be a touch screen.

The device 100 includes a massage attachment 114 which serves as a treatment structure. For example, a wedge massage attachment is depicted in FIG. 1, but other massage attachments, such as a ball massage attachment, etc., may be utilized in its place.

In a preferred embodiment, the device 100 is associated with and can be operated by an app or software that runs on a mobile device such as a phone, watch or tablet (or any computer). The app can connect to the device 100 via Bluetooth or other connection protocol. The app can have any or all of the following functions. Furthermore, any of the functions discussed herein can be added to the touch screen/scroll wheel or button(s) capability directly on the device. If the user walks or is located too far away from the device, the device will not work or activate. The device can be turned on and off using the app as well as the touch screen or button on the device. The app can control the variable speeds (e.g., anywhere between 1750-3000 RPM). The app can include a timer so the device stops after a predetermined period of time. The app can also include different treatment protocols associated therewith. This will allow the user to choose a protocol or area of the body they want to work on. When the start of the protocol is selected, the device will run through a routine. For example, the device may run at a first RPM for a first period of time and then run at a second RPM for a second period of time and/or at a first amplitude for a first period of time and then run at a second amplitude for a second period of time. The routines can also include prompts (e.g., haptic feedback) for letting the user to know to move to a new body part. These routines or treatments can be related to recovery, blood flow increase, performance, etc. and can each include a preprogrammed routine. The routines can also prompt or instruct the user to switch treatment structures or positions of the arm or rotation head. The prompts can include sounds, haptic feedback (e.g., vibration of the device or mobile device), textual instructions on the app or touch screen, etc. For example, the app may instruct the user to start with the ball treatment structure with the arm in position two. Then the user taps start and the device runs at a first frequency for a predetermined amount of time. The app or device then prompts the user to begin the next step in the routine and instructs the user to change to the cone treatment structure and to place the arm in position 1. The user taps start again and the device runs at a second frequency for a predetermined amount of time.

FIGS. 2-5 show the brushless motor 102. A brushless DC motor (e.g., BLDC motor) is a permanent magnet synchronous electric motor driven by direct current (DC) electricity. In practice, a BLDC motor is electrically commutated (i.e., rotational torque is generated by changing phase currents through the motor at specified timing). A BLDC motor uses a permanent magnet rotor that rotates across a sequence of coils provided by a stator. The coils are switched electronically at correct rotor positions to create rotational force acting on the rotor. The rotor is affixed to a shaft, whereby the motor generates rotational torque. Because BLDC motors are brushless, which eliminates brushes making mechanical contact with a commutator on a rotor, BLDC motors are generally more reliable and may run at high speeds with greater efficiency.

Figure 2:
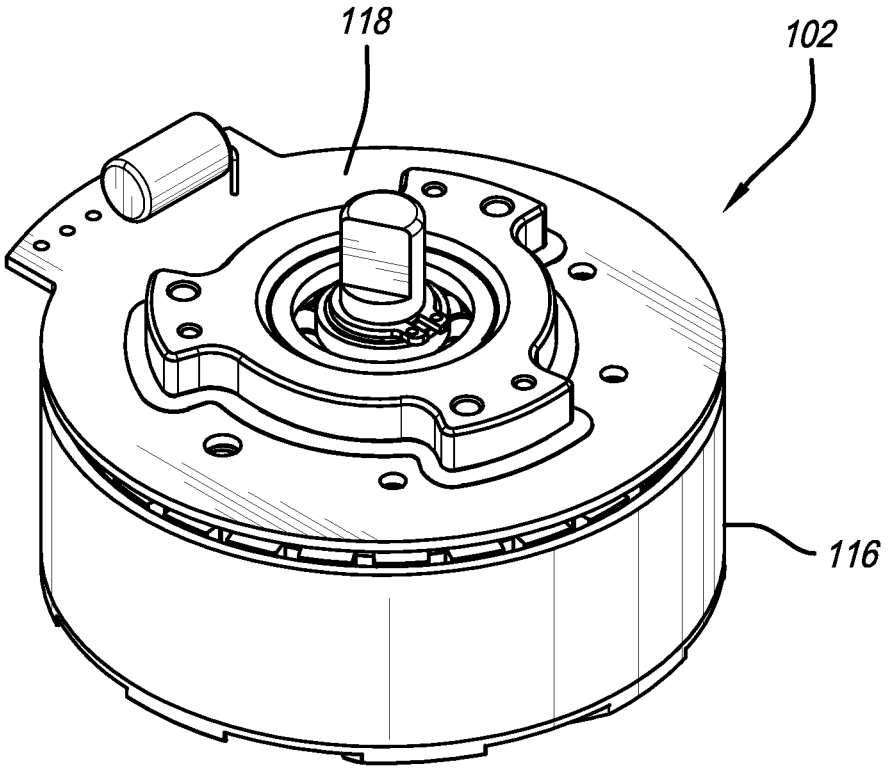
FIG. 2 is a top perspective view of a motor configured to be utilized in connection with a percussive massage device.
Figure 3:
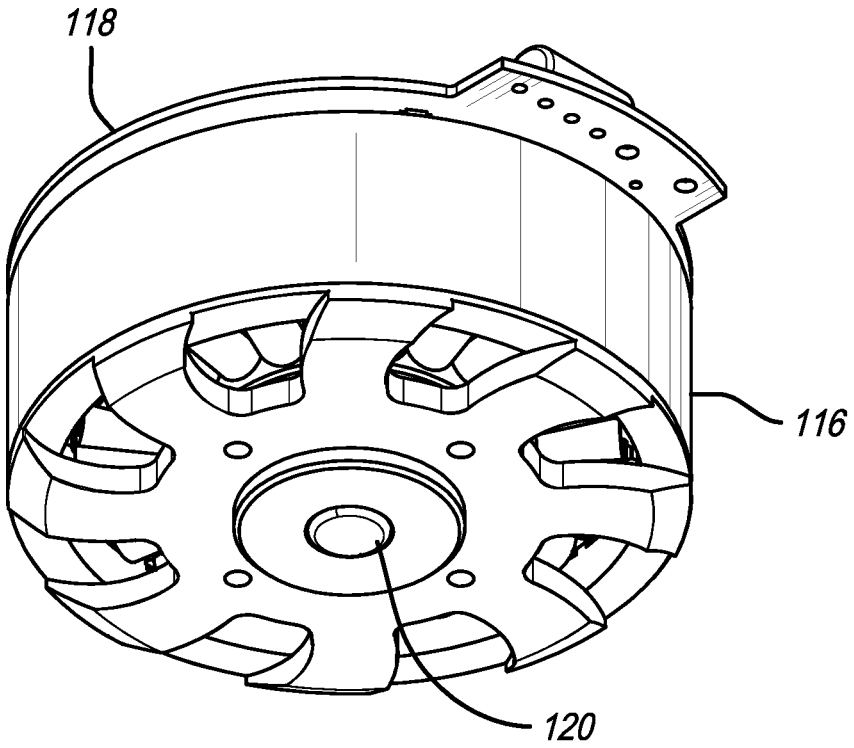
FIG. 3 is a bottom perspective view of the motor of FIG. 2.

FIG. 2 is a top perspective view of the motor 102 configured to be utilized in connection with the percussive massage device 100. The motor 102 includes a motor housing 116 and an end plate 118. FIG. 3 is a bottom perspective view of the motor 102 configured to be utilized in connection with the percussive massage device 100. The motor 102 in this view depicts a bottom view of the housing 116 and the end plate 118, and a shaft 120.

Figure 4:
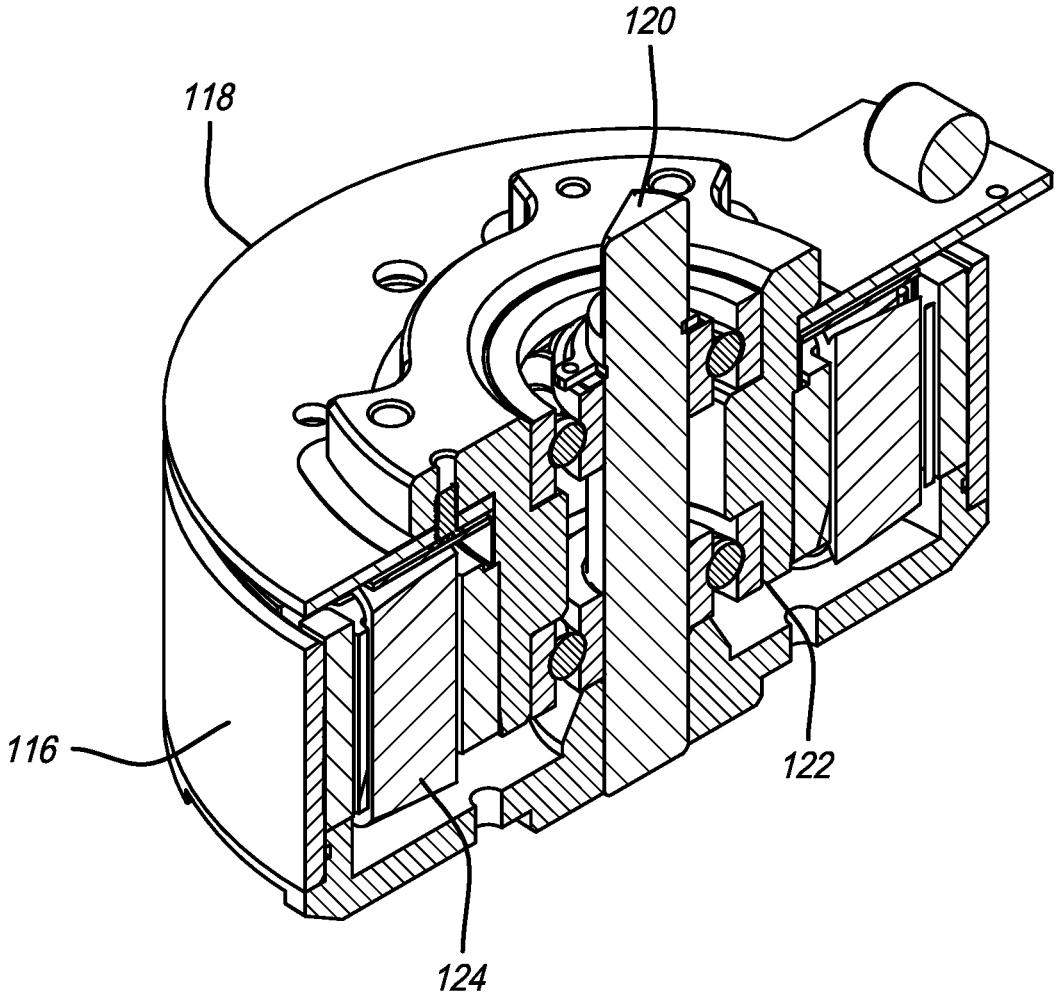
FIG. 4 is a cross-section of the motor of FIG. 2.

FIG. 4 is a cross-sectional view of the motor 102 configured to be utilized in connection with a percussive massage device. The motor 102 in this view includes the housing 116, the end plate 118, and the shaft 120. The motor 102 further depicts a rotor 122 coupled to the shaft 120 and a stator 124. FIG. 4 reveals inner components of the motor 102, such as a rotor 122 and a stator 124.

Figure 5:
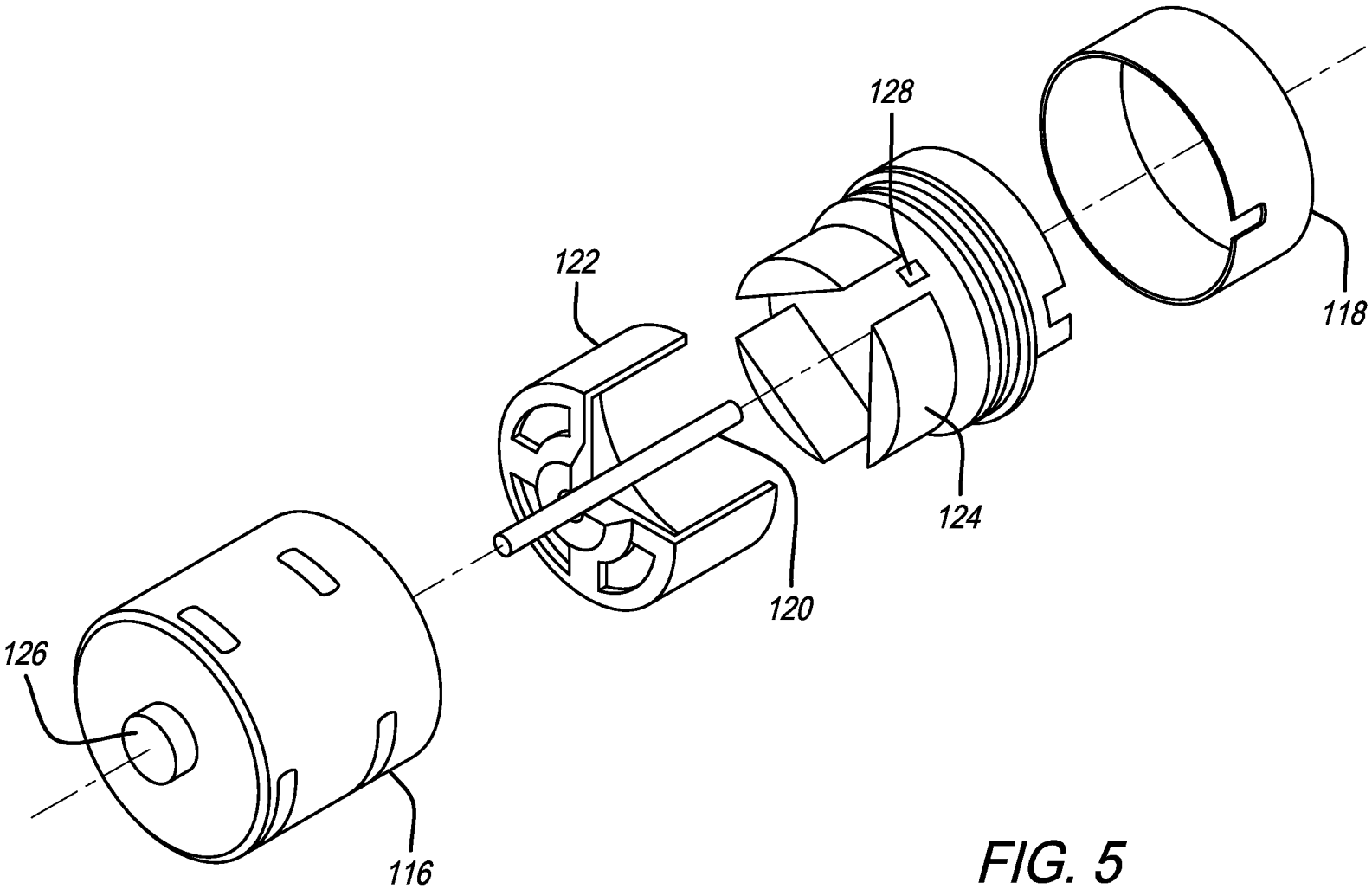
FIG. 5 is an exploded view of a motor configured to be utilized in connection with a percussive massage device.
Figure 6:
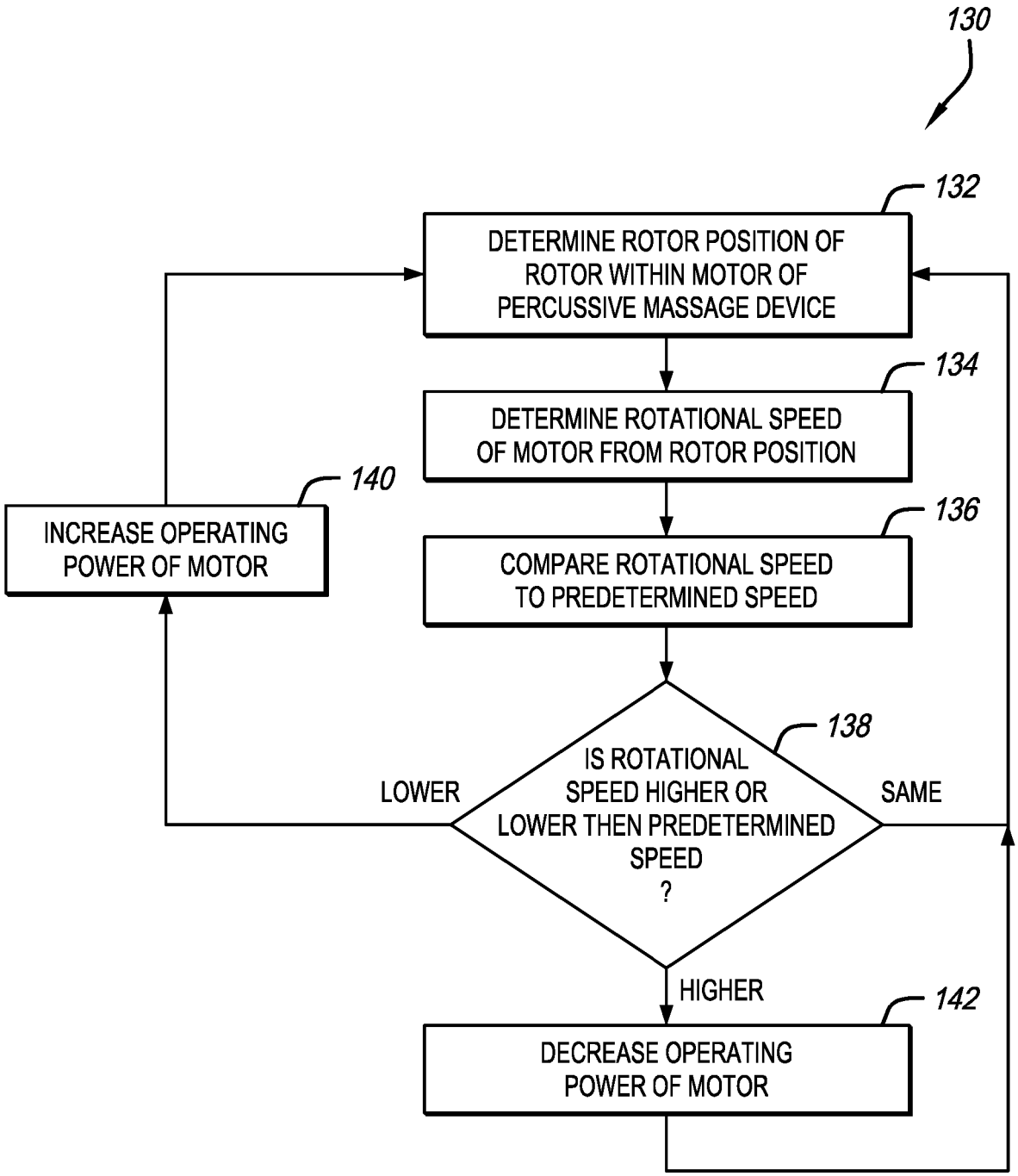
FIG. 6 is a flowchart diagram of a method of providing consistent percussive effect utilizing a percussive massage device.

FIG. 5 is an exploded view of a motor 102 configured to be utilized in connection with the percussive massage device 100. As with FIG. 4, FIG. 5 depicts the housing 116, the end plate 118, the shaft 120, the rotor 122, and the stator 124. FIG. 5 also depicts a bearing 126 and a Hall effect sensor 128. As described above, BLDC motors generate rotational torque utilizing permanent magnets on the rotor 122 and stator coils through which electrical current is passed.

One of ordinary skill in the art would understand that while particular types of BLDC motors have been depicted in FIGS. 1-5, other types of BLDC motors may be utilized without departing from the scope of the present invention. Depending on the stator windings, BLDC motors can be configured as single-phase, two-phase, or three-phase motors. Still further, while BLDC motors have been depicted throughout, other types of motors may be utilized without departing from the scope of the present invention.

In an embodiment utilizing a brushless DC motor 102, a brushless DC motor 102 allows monitoring of motor rotor positions through one or more Hall effect sensors 128. This capability allows the device 100 to more accurately read and control the motor's speed. One of ordinary skill in the art would understand that a Hall effect sensor 128 is a solid-state magnetic field sensor that causes a charge to build up on a capacitor (through which current is flowing) that passes through the magnetic field. The charge buildup on the capacitor translates into a corresponding voltage. Other types of sensors may be utilized in a motor to provide accurate monitoring of motor rotor positions and thus, speed detectors for motor control. For example, while Hall-effect sensors are used in combination with brushless DC motors, an embodiment utilizing permanent-magnet AC synchronous motors may utilize a shaft encoder or resolver for rotor position sensing. In other embodiments, an electromagnetic variable reluctance sensor or accelerometer may be utilized to monitor rotor positions and thus, motor speed.

FIG. 6 is a flowchart diagram of a method 130 of providing consistent percussive effect utilizing a percussive massage device. At Step 132, the rotor position of the rotor 122 within the motor 102 of the percussive massage device 100 is determined. As described herein, while a Hall effect sensor 128 is preferred in conjunction with a BLDC motor 102, other sensors or components may be utilized to determine the rotor position of the rotor 122.

At Step 134, the rotational speed of the motor 102 is determined from the rotor position. A controller in conjunction with firmware or software may be utilized to calculate the rotational speed from the rotor position.

At Step 136, the rotational speed of the motor 102 is compared with a predetermined speed. For example, as described herein, a user may specify the predetermined speed in RPMs by way of the controls 112 or an app or other software.

At Step 138, the determination is made whether the rotational speed is higher or lower than the predetermined speed. If the rotational speed is lower than the predetermined speed, then at Step 140, the operating power of the motor is increased. As depicted in FIG. 6, once the operating power of the motor is increased, the method 130 continually monitors and updates the comparison of the rotational speed to the predetermined speed to determine whether to increase the operating power of the motor further.

If the rotational speed of the motor is higher than the predetermined speed, then at Step 142, the operating power of the motor is decreased. As depicted in FIG. 6, once the operating power of the motor is decreased, the method 130 continually monitors and updates the comparison of the rotational speed to the predetermined speed to determine whether to decrease the operating power of the motor further.

A percussive massage device 100 according to a preferred embodiment therefore ensures consistent percussive effect throughout a range of applied force. It is advantageous to deliver consistent percussive effect to achieve the desired result of a percussive massage device 100. In use, as the applied force increases (e.g., the user pushes harder on the device), the motor may slow down and, as a result, the percussive effect of the percussive massage device 100 may decrease. Thus, as the percussive effect is directly proportional to the motor's speed (e.g., rotations per minute), it is desirable to increase the motor's speed at the higher applied force to achieve consistent percussive effect. As the applied force decreases, however, the percussive effect of the percussive massage device 100 may increase. Thus, it is desirable to decrease the motor's speed at lower applied force to achieve consistent percussive effect.

To ensure that the percussive massage device 100 maintains a consistent percussive effect at varying levels of applied force, a controller may increase the power output of the device 100 to keep the motor 102 rotating at a consistent or relatively consistent speed. As discussed above, a speed-detecting device such as a Hall effect sensor 128 or other sensing device may be utilized to provide accurate motor speed to a controller. Thus, the controller continuously monitors the motor speed using the speed-detecting device and increases the power output of the device 100 to ensure that the speed of the motor 102 remains constant. The constant motor speed is directly proportional to a consistent percussive effect, regardless of the amount of force applied by the percussive massage device.

The controller may also monitor the maximum power output of the device 100 to limit the power output of the device 100. This ensures that the device 100 does not exceed a maximum safe operating power. The maximum safe operating power can be predetermined. As a result, however, the device 100 may be limited in the amount of percussive effect (i.e., motor speed) it may achieve depending on the maximum power output. Depending on the maximum power output, therefore, a percussive massage device 100 may have an inherent upper limit on the amount of percussive effect it may achieve at a particular applied force.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

Although the operations of any method(s) disclosed or described herein either explicitly or implicitly are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

The teachings of the disclosure provided herein can be applied to other systems, not necessarily the system described above. The elements and acts of the various embodiments described above can be combined to provide further embodiments. Any measurements or dimensions described or used herein are merely exemplary and not a limitation on the present invention. Other measurements or dimensions are within the scope of the invention.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. § 112,¶6, other aspects may likewise be embodied as a means-plus-function claim, or in other forms, such as being embodied in a computer-readable medium. (Any claims intended to be treated under 35 U.S.C. § 112, ¶6 will include the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A percussive massage device comprising:

a housing having three handle portions configured to be grasped by a user and connected to each other in a triangular shape;

a motor that includes a rotor, wherein the motor is disposed in a joining portion of two of the three handle portions;

a push rod in a unitary body having a proximal end operatively and directly connected to the motor at a connection portion at a center of an axis of the motor, wherein the push rod includes bearings at its proximal end and is configured to reciprocate in response to activation of the motor, and wherein the push rod extends out from a center of the motor, partially disposed over the motor;

a massage attachment coupled to a distal end of the push rod, wherein the proximal end of the push rod extends from the connection portion of the motor to the distal end of the push rod in an arc shape such that the connection portion of the motor, at which the proximal end of the push rod is connected, is offset from a reciprocating path that the distal end of the push rod travels;

a sensor configured to detect a rotor position of the rotor;

a force meter configured to determine a force exerted by the massage attachment on a user's body part; and a controller configured to:

receive the rotor position and determine a rotational speed of the motor based on the rotor position, increase or decrease an operating power of the motor to respectively increase or decrease the rotational speed to maintain a percussive effect, and execute a protocol comprising a first step for running the motor at a first rotational speed for a first duration and a second step for running the motor at a second rotational speed for a second duration, wherein during each of the first duration and the second duration, the controller is further configured to:

determine that a first force measured at a first measurement time is smaller than a second force measured at a second measurement time, wherein the second measurement time occurs after the first measurement time, and increase, based on the determining, the operating power of the motor to maintain the percussive effect during a respective one of the first duration and the second duration, wherein the increasing of the operating power of the motor comprises raising the rotational speed of the motor to match a respective one of the first and second rotational speeds.

2. The percussive massage device of claim 1, wherein the controller is configured to decrease the operating power of the motor when the second force measured at the second measurement time is smaller than the first force measured at the first measurement time, and wherein the decreasing of the operating power of the motor comprises reducing the rotational speed of the motor to match a respective one of the first and second rotational speeds.

3. The percussive massage device of claim 1, wherein the motor is a brushless DC motor.

4. The percussive massage device of claim 1, wherein the sensor is a Hall effect sensor.

5. The percussive massage device of claim 1, wherein the controller is configured to limit the operating power to a predetermined maximum safe operating power.

6. A method of providing consistent percussive effect in a percussive massage device, which has a housing having three handle portions configured to be grasp by a user and connected to each other in a triangular shape, comprising a motor with a rotor disposed in a joining portion of two of the three handle portions, the method comprising the steps of:

determining a rotor position of the rotor;

determining a rotational speed of the motor from the rotor position;

increasing or decreasing an operating power of the motor to respectively increase or decrease the rotational speed to maintain a percussive effect;

determining a force exerted by a massage attachment reciprocating offset from the motor on a user's body part, wherein the massage attachment is coupled to a distal end of a push rod, the push rod in a unitary body having a proximal end operatively and directly connected to the motor and extending to the distal end in an arc shape such that a connection portion, at which the proximal end of the push rod is connected to the motor, is offset from a reciprocating path that the distal end of the push rod travels, wherein the push rod includes bearings at its proximal end and is configured to reciprocate in response to activation of the motor, and wherein the push rod extends out from a center of the motor, partially disposed over the motor; and executing a protocol comprising a first step for running the motor at a first rotational speed for a first duration and a second step for running the motor at a second rotational speed for a second duration, wherein during each of the first duration and the second duration, the method further comprises:

determining, by the controller, that a first force measured at a first measurement time is smaller than a second force measured at a second measurement time, wherein the second measurement time occurs after the first measurement time; and increasing, based on the determining, the operating power of the motor to maintain the percussive effect during a respective one of the first duration and the second duration, wherein increasing the operating power of the motor comprises raising the rotational speed of the motor to match a respective one of the first and second rotational speeds.

7. The method of claim 6, further comprising decreasing the operating power of the motor when the second force measured at the second measurement time is smaller than the first force measured at the first measurement time, and wherein the decreasing of the operating power of the motor comprises reducing the rotational speed of the motor to match a respective one of the first and second rotational speeds.

8. The method of claim 6, wherein the motor is a brushless DC motor.

9. The method of claim 6, wherein the rotor position is determined utilizing a Hall effect sensor.

10. The method of claim 6, wherein the operating power of the motor is limited to not exceed a predetermined maximum safe operating power.

* * * * *